US011082790B2

(12) United States Patent
Arteaga et al.

(10) Patent No.: US 11,082,790 B2
(45) Date of Patent: Aug. 3, 2021

(54) RENDERING AUDIO OBJECTS HAVING APPARENT SIZE

(71) Applicant: DOLBY INTERNATIONAL AB, Amsterdam Zuidoost (NL)

(72) Inventors: Daniel Arteaga, Barcelona (ES); Giulio Cengarle, Barcelona (ES); Antonio Mateos Sole, Barcelona (ES)

(73) Assignee: Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 16/607,472

(22) PCT Filed: May 1, 2018

(86) PCT No.: PCT/EP2018/061071

§ 371 (c)(1),
(2) Date: Oct. 23, 2019

(87) PCT Pub. No.: WO2018/202642

PCT Pub. Date: Nov. 8, 2018

(65) Prior Publication Data

US 2020/0145773 A1 May 7, 2020

Related U.S. Application Data

(60) Provisional application No. 62/528,798, filed on Jul. 5, 2017.

(30) Foreign Application Priority Data

May 4, 2017 (ES) ..... ES201730658
Jul. 5, 2017 (EP) ..... 17179710

(51) Int. Cl.

| | |
|---|---|
| ***H04S 3/02*** | (2006.01) |
| ***H04S 3/00*** | (2006.01) |
| ***H04S 7/00*** | (2006.01) |

(52) U.S. Cl.
CPC ..... *H04S 3/02* (2013.01); *H04S 3/008* (2013.01); *H04S 7/307* (2013.01); *H04S 2420/03* (2013.01)

(58) Field of Classification Search
CPC ..... G10L 19/008; G10L 19/20; G10L 19/22; H04S 2400/11; H04S 2420/11
(Continued)

(56) References Cited

U.S. PATENT DOCUMENTS 6,721,694 B1 4/2004 Lambrecht
7,095,678 B2 8/2006 Winbow
(Continued)

FOREIGN PATENT DOCUMENTS

AU 2013263871 B2 7/2015
CN 103279612 A 9/2013
(Continued)

OTHER PUBLICATIONS

Do, H. et al., "A Fast Microphone Array SRP-PHAT Source Location Implementation Using Course-to-Fine Region Contraction (CFRC)", IEEE, Oct. 24, 2007, pp. 295-298.
(Continued)

*Primary Examiner* — Alexander Krzystan

(57) ABSTRACT

Methods, systems, and computer program products for rending an audio object having an apparent size are disclosed. An audio processing system receives audio panning data including a first grid mapping first virtual sound sources in a space and speaker positions to speaker gains. The first grid specifies first speaker gains of the first virtual sound sources in the space. The audio processing system determines a second grid of second virtual sound sources in the space, including mapping the first virtual sound sources into the second virtual sound sources of the second virtual sources. The audio processing system selects at least one of the first grid
(Continued)

or second grid for rendering an audio object based on an apparent size of the audio object. The audio processing system renders the audio object based on the selected grid or grids.

14 Claims, 9 Drawing Sheets

(58) Field of Classification Search
USPC ..... 381/310, 22
See application file for complete search history.

(56) References Cited

U.S. PATENT DOCUMENTS

| | | | | |
|---|---|---|---|---|
| 8,983,779 | B2 | 3/2015 | Liu | |
| 9,047,674 | B2 | 6/2015 | Su | |
| 9,432,790 | B2 | 8/2016 | Raghuvanshi | |
| 9,654,895 | B2 | 5/2017 | Breebaart | |
| 9,712,939 | B2 | 7/2017 | Mateos Sole | |
| 9,747,909 | B2 | 8/2017 | Breebaart | |
| 9,949,052 | B2 | 4/2018 | Wang | |
| 2007/0024615 | A1* | 2/2007 | Keller | G06T 15/506 345/421 |
| 2009/0138246 | A1* | 5/2009 | Chow | G06F 30/23 703/2 |
| 2011/0299361 | A1 | 12/2011 | Shin | |
| 2013/0096899 | A1 | 4/2013 | Usadi | |
| 2013/0317749 | A1 | 11/2013 | Borger | |
| 2014/0214388 | A1 | 7/2014 | Gorell | |
| 2014/0314251 | A1 | 10/2014 | Rosca | |
| 2014/0348337 | A1 | 11/2014 | Franck | |
| 2014/0355793 | A1* | 12/2014 | Dublin | H04S 7/303 381/302 |
| 2016/0007133 | A1 | 1/2016 | Mateos Sole et al. | |
| 2016/0044410 | A1* | 2/2016 | Makinen | H04R 3/005 381/26 |
| 2016/0337777 | A1* | 11/2016 | Tsuji | H04S 3/008 |
| 2017/0019746 | A1* | 1/2017 | Oh | G10L 19/20 |
| 2018/0249274 | A1* | 8/2018 | Lyren | H04S 7/303 |
| 2019/0246236 | A1* | 8/2019 | Ehara | G10L 19/008 |

FOREIGN PATENT DOCUMENTS

| | | | |
|---|---|---|---|
| EP | 2892250 | A1 | 7/2015 |
| JP | 2011154510 | A | 8/2011 |
| WO | 2015060600 | A1 | 4/2015 |

OTHER PUBLICATIONS

Ishizuka, T., et al, "Variable-grid Technique for Sound Field Analysis Using the Constrained Interpolation Profile Method, Compendex Acoustical Science and Technology", 2012, pp. 387-390, v 33, Acoustical Society of Japan.

Tang, Z. et al. "A Combination of Algebraic Multigrid Method and Adaptive Mesh Refinement for Large-Scale Electromagnetic Field" IEEE, May 12, 2010, p. 1.

Potard, G. et al "Decorrelation techniques for the rendering of apparent sound source width in 3d audio displays." Proc. Int. Conf. on Digital Audio Effects (DAFx'04). 2004.

* cited by examiner

RENDERING AUDIO OBJECTS HAVING APPARENT SIZE

CROSS-REFERENCE TO RELATED APPLICATIONS

This application claims priority of the following priority applications: Spanish Application P201730658, filed 4 May 2017, U.S. provisional application 62/528,798, filed 5 Jul. 2017 and EP application 17179710.3, filed 5 Jul. 2017, which are hereby incorporated by reference.

TECHNICAL FIELD

This disclosure relates generally to the audio playback systems.

BACKGROUND

A modern audio processing system can be configured to render one or more audio objects. An audio object can include a stream of audio signals associated with metadata. The metadata can indicate a position and an apparent size of the audio object. The apparent size indicates a spatial size of a sound that a listener should perceive when the audio object is rendered in a reproduction environment. The rendering can include computing a set of audio object gain values for each channel of a set of output channels. Each output channel can correspond to a playback device, e.g., a speaker.

An audio object may be created without reference to any particular reproduction environment. The audio processing system can render the audio object in a reproduction environment in a multi-step process that includes a setup process and a runtime process. During the setup process, an audio processing system can define multiple virtual sound sources in a space within which the audio object is positioned and within which the audio object may move. A virtual sound source corresponds to a location of a static point source. The setup process receives speaker layout data. The speaker layout data indicates positions of some or all speakers of the reproduction environment. The setup process computes respective speaker gain values for each virtual sound source for each speaker based on the speaker location and the virtual source locations. At runtime when audio objects are rendered, the runtime process computes, for each audio object, contributions of one or more virtual sound sources that are located within an area or volume defined by the audio object position and the audio object apparent size. The runtime process then represents the audio object by the one or more virtual sound sources, and outputs speaker gains for the audio object.

SUMMARY

Techniques of rendering an audio object having an apparent size are described. An audio processing system receives audio panning data including a first grid mapping first virtual sound sources in a space and speaker positions to speaker gains. The first grid specifies first speaker gains of the first virtual sound sources in the space. The audio processing system determines a second grid of second virtual sound sources in the space, including mapping the first speaker gains into second speaker gains of the second virtual sources. The first grid is denser than the second grid in terms of number of virtual sound sources. The audio processing system selects at least one of the first grid or second grid for rendering an audio object, the selecting being based on an apparent size of the audio object. The audio processing system renders the audio object based on the selected grid, including representing the audio object using one or more virtual sound sources in the selected grid that are enclosed in a volume or area having the apparent size.

The features described in this specification can achieve one or more advantages over conventional audio rendering technology for reproducing three-dimensional sound effect. For example, the disclosed techniques reduce computation complexity of audio rendering. A conventional system represents a large audio object with many virtual sound sources. When dealing with large audio object sizes, a conventional system needs to consider the many virtual sound sources simultaneously. The simultaneous computing can be challenging, especially in low-power embedded systems. For example, a grid can have a size of 11 by 11 by 11 virtual sound sources. For an audio object whose size spans the entire listening area, which is not uncommon, a conventional rendering system needs to consider 1331 virtual sound sources simultaneously and add them together. The disclosed technology, by generating a coarser, lower-density virtual source grid, can give approximately the same result as produced by a conventional higher-density grid of virtual sound sources, but with much lower computational complexity. For example, by using a coarse grid having a size of 7 by 7 by 7 virtual sound sources, an audio rendering system using the disclosed technology requires at most 343 virtual sound sources and uses about 26% of the memory of a conventional system using a 11 by 11 by 11 grid. An audio rendering system using a 5 by 5 by 5 coarse grid uses about 9% of the memory. An audio rendering system using a 3 by 3 by 3 coarse grid uses only about 2% of the memory. The reduced memory requirement can reduce system cost and reduce power consumption without sacrificing playback quality.

The details of one or more implementations of the disclosed subject matter are set forth in the accompanying drawings and the description below. Other features, aspects and advantages of the disclosed subject matter will become apparent from the description, the drawings and the claims.

BRIEF DESCRIPTION OF THE DRAWINGS

Like reference symbols in the various drawings indicate like elements.

DETAILED DESCRIPTION

Rendering Audio Objects Using Coarse Grids

Figure 1:
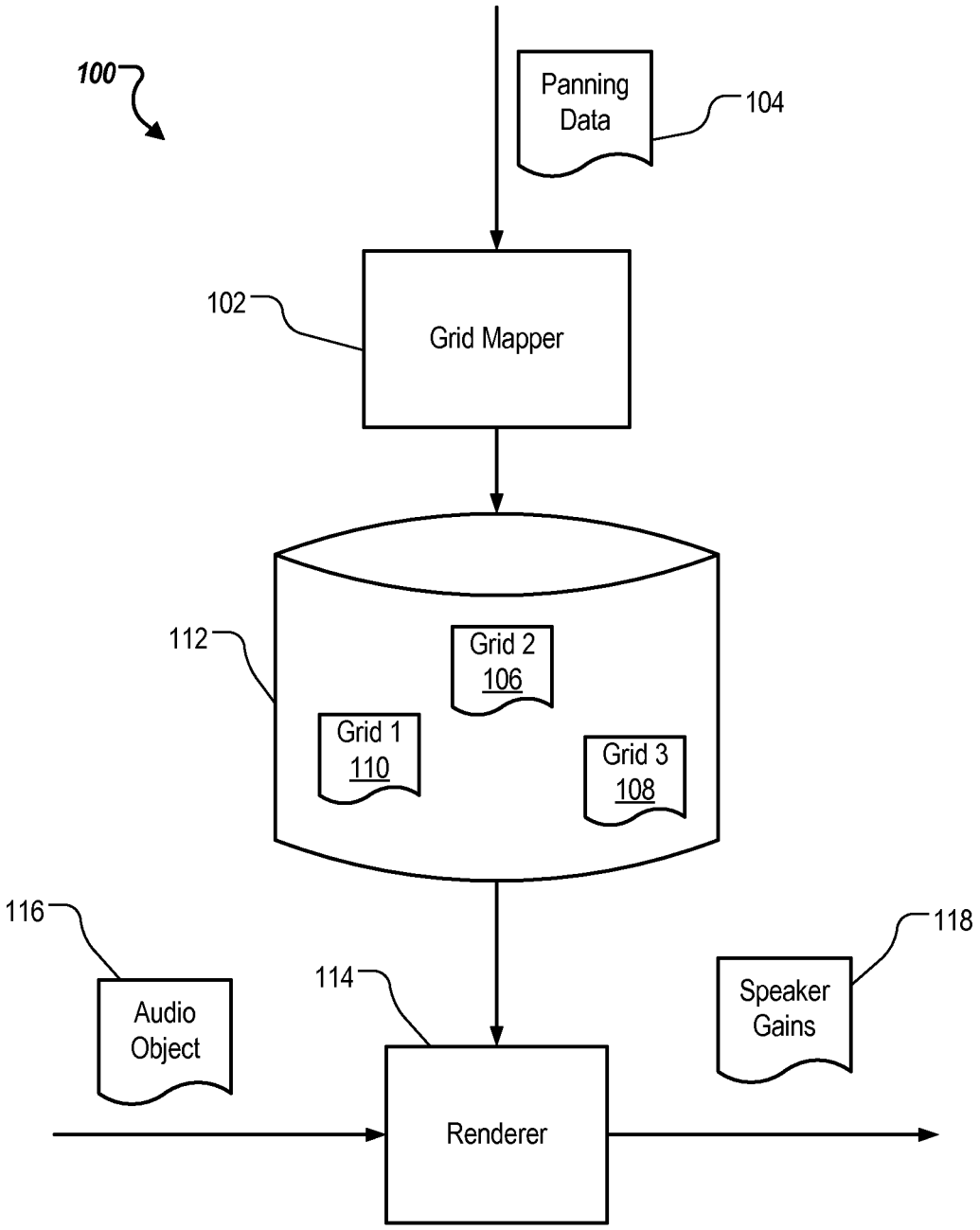
FIG. 1 is a block diagram illustrating an example audio processing system implementing coarse grid rendering.

FIG. 1 is a block diagram illustrating an example audio processing system 100 implementing coarse grid rendering. The audio processing system 100 includes a grid mapper 102. The grid mapper 102 is a component of the audio processing system 100 including hardware and software components configured to execute a setup process. The grid mapper 102 can receive panning data 104. The panning data 104 can include a pre-computed original grid (e.g., first grid). Example techniques of determining the original grid are described in U.S. Publication Number 2016/0007133. The received original grid includes a two-dimensional or three-dimensional grid of virtual sound sources (e.g., first virtual sound sources) distributed across a unit space, e.g., a listening room. The received original grid has a first density, as measured by number of virtual sound sources in the space, e.g., 11 by 11 by 11 virtual sound sources, which corresponds to eleven virtual sound sources across the width of the space, eleven virtual sound sources along a length of the space, and eleven virtual sound sources over a height of the space. For convenience, examples in this specification have widths, lengths and heights that are equal in terms of number of virtual sound sources. In various implementations, the width, lengths and heights can be different. For example, a grid can have 11 by 11 by 9 virtual sound sources. Each virtual sound source is a point source. In the examples shown, virtual sound sources are evenly distributed in the space, where distances between two neighboring virtual sound sources along a length dimension and a width dimension, and optionally a height dimension, are equal. In some implementations, the virtual sound sources can be distributed unevenly, e.g., denser where sound energies are expected to be higher or spatial resolution that is required is higher. The received original grid maps speaker gains (e.g., first speaker gains) of the virtual sound sources to one or more speakers according to a speaker layout in a listening environment. The received original grid specifies a respective amount of speaker gain that each virtual sound source contributes to each speaker.

By executing a setup process, the grid mapper 102 maps the received original fine grid to one or more grids that are coarser. The terms "fine" and "coarse" as used in this specification are relative terms. Grid A is a fine grid relative to Grid B, and Grid B is a coarse grid relative to Grid A, if Grid A is denser than Grid B, e.g., if Grid A has more virtual sound sources than Grid B has. The virtual sound sources in Grid A can be referred to as fine virtual sound sources. The virtual sound in Grid B are referred to as coarse virtual sound sources.

The grid mapper 102 can determine a second grid 106 that is populated by fewer virtual sound sources, e.g., 5 by 5 by 5, than those in the received original grid. Relatively to one another, the second grid 106 is a coarse grid, and the original grid is a fine grid. The grid mapper 102 can determine a third grid 108 that is populated by yet fewer virtual sound sources, e.g., 3 by 3 by 3 virtual sound sources. The third grid 108 is a coarser grid. Each of the second grid 106 and third grid 108 maps speakers gains of virtual sound sources in the respective virtual grid to speaker gains according to the same speaker layout in the listening environment. Each of the second grid 106 and third grid 108 specifies an amount of speaker gain each coarse virtual sound source contributes to each speaker. The grid mapper 102 then stores the second grid 106 and the third grid 108, as well as the original grid 110, in a storage device 112. The storage device 112 can be a non-transitory storage device, e.g., a disk or memory of the audio processing system 100.

A renderer 114 can render one or more audio objects at runtime, after speaker positions are setup. The runtime can be playback time when audio signals are played on speakers. The renderer 114, e.g., an audio panner, includes one or more hardware and software components configured to performing panning operations that map audio objects to speakers. The renderer 114 receives an audio object 116. The audio object 116 can include a location parameter and a size parameter. The location parameter can specify an apparent location of the audio object in the space. The size parameter can specify an apparent size that a spatial sound field of the audio object 116 shall appear during playback. Base on the size parameter, the renderer 114 can select one or more of the original grid 110, the second grid 106, or the third grid 108 for rendering the audio object. In general, the render 114 can select a finer grid for a smaller apparent size. The renderer 114 can map the audio object 116 to one or more audio channels, each channel corresponding to a speaker. The renderer 114 can output the mapping as one or more speaker gains 118. The renderer 114 can submit the speaker gains to one or more amplifiers, or to one or more speakers directly. The renderer 114 can select the grids dynamically, using fine grids for smaller audio objects and using coarse grids for larger audio objects.

Figure 2:
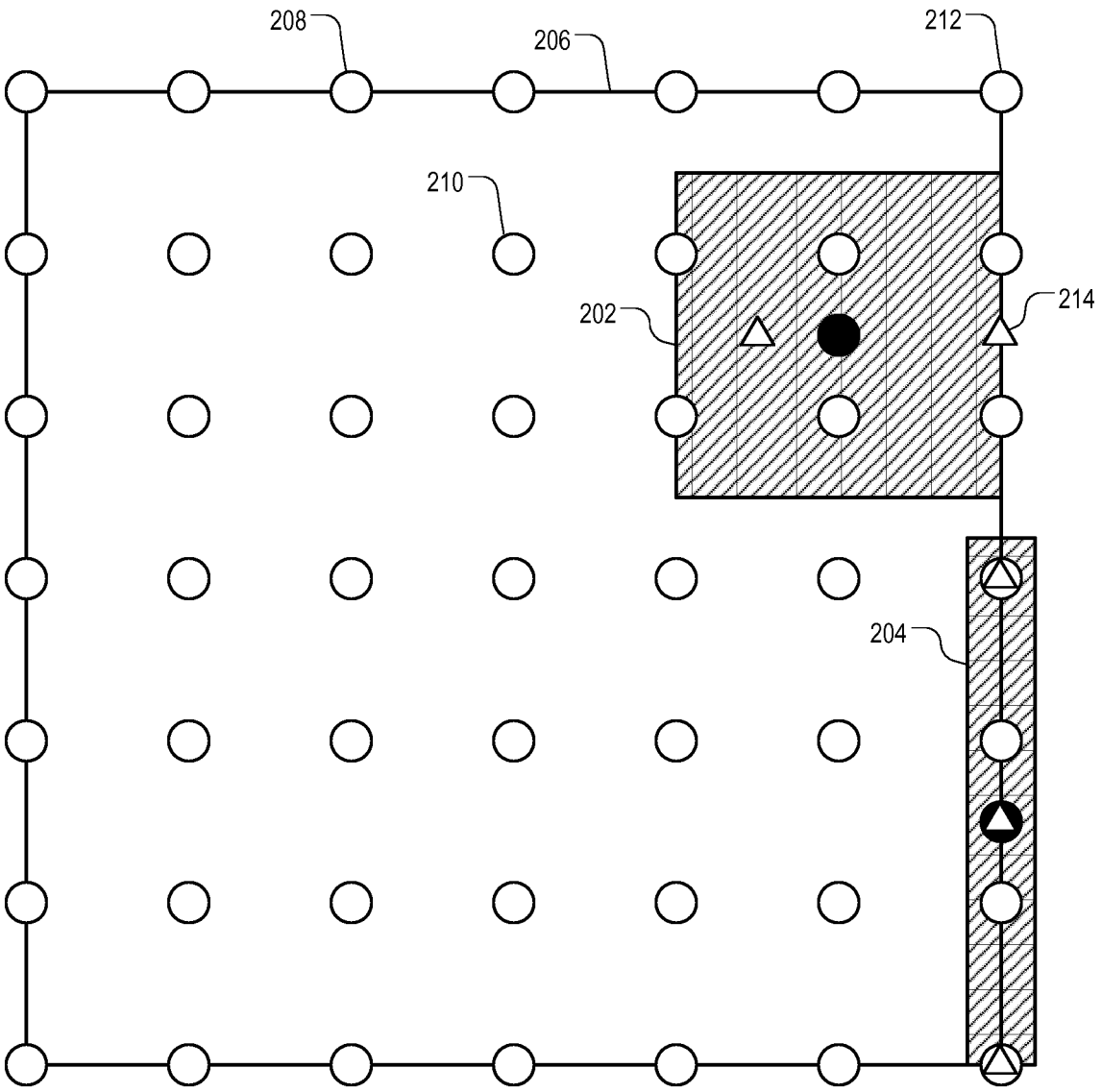
FIG. 2 is diagram illustrating example audio objects associated with respective apparent sizes.

FIG. 2 is diagram illustrating example audio objects associated with respective apparent sizes. An audio encoding system can encode a particular audio scene, e.g., a band playing at a venue, as one or more audio objects. In the example shown, an audio processing system, e.g., the audio processing system 100 of FIG. 1, renders audio objects 202 and 204. Each of the audio objects 202 and 204 includes a location parameter and a size parameter. The location parameter can include location coordinates that indicates a respective location of the corresponding audio object in a unit space. The space can be a three-dimensional volume having any geometrical shape. In the example shown, a two-dimensional projection of the space is shown. In the example shown, the locations of the audio objects 202 and 204 are represented as black circles in the centers of the audio objects 202 and 204, respectively.

A grid 206 of virtual sound sources represents locations in the space. The virtual sound sources include, for example, a virtual sound source 208, a virtual sound source 210, and a virtual sound source 212. Each virtual sound source is represented as a white circle in FIG. 2. The grid 206 spatially coincides with the space. For convenience, a 7 by 7 projection is shown. Virtual sound sources, e.g., the virtual sound sources 208 and 212, that are located on an outer boundary of the grid 206 are designated as external virtual sound sources. Virtual sound sources, e.g., the virtual sound source 210, that are located inside of the grid 206 are designated as internal virtual sound sources. An external virtual sound source, e.g., the virtual sound source 208, that is not located at a corner of the grid 206 is designated as a non-corner sound source. An external virtual sound source, e.g., the virtual sound source 212, that is located at a corner of the grid 206 is designated as a corner sound source.

Shapes of audio object 202 and audio object 204 can be zero-dimensional, one-dimensional, two-dimensional, three-dimensional, spherical, cubical or have any other regular or irregular form. The size parameter of each of the audio objects 202 and 204 can specify a respective apparent size of each audio object. A renderer can active all virtual sound sources falling inside the size shape simultaneously, with activation factors that depend on the exact number of virtual sound sources and, optionally, a windowing factor. During playback, contributions from all virtual sound sources to the available speakers are added together. The addition of the sources need not be necessarily linear. A quadratic addition law, to preserve the RMS value might be implemented. Other addition laws can be used. For audio objects at the boundary, e.g., the audio object 204, the renderer may add together only external virtual sound sources located on that boundary. If the audio object 204 spans the entire boundary, in this example, seven virtual sound sources (49 in a three-dimensional space) will be needed to represent the audio object 204. Likewise, if the audio object 202 fills the entire space, in this example, 49 virtual sound sources (343 in a three-dimensional space) will be needed to represent the audio object 202. An audio processing system, e.g., the audio processing system 100 of FIG. 1, can reduce the number of virtual sound sources needed to represent the audio object 202 and the audio object 204 using a coarse grid that is coarser than the grid 206. The audio processing system can create the coarse grid using cell allocation techniques, which are described below in additional details.

An audio processing system can determine which virtual sound source or virtual sound sources represent an audio object based on the location parameter and the size parameter associated with that object. In the example shown, the audio object 202 is represented by six virtual sound sources including four internal virtual sound sources and two external audio sources. The audio object 204 is represented by four external virtual sound sources. The audio processing system shall perform partitioning and mapping operations to represent the audio objects 202 and 204 using fewer virtual sound sources in a coarse grid. For example, the audio processing system can represent the audio objects 202 and 204 using one or more coarse virtual sound sources, e.g., a coarse virtual sound source 214, in the coarse grid. The coarse virtual sound sources are shown as white triangles in FIG. 2.

Figure 3:
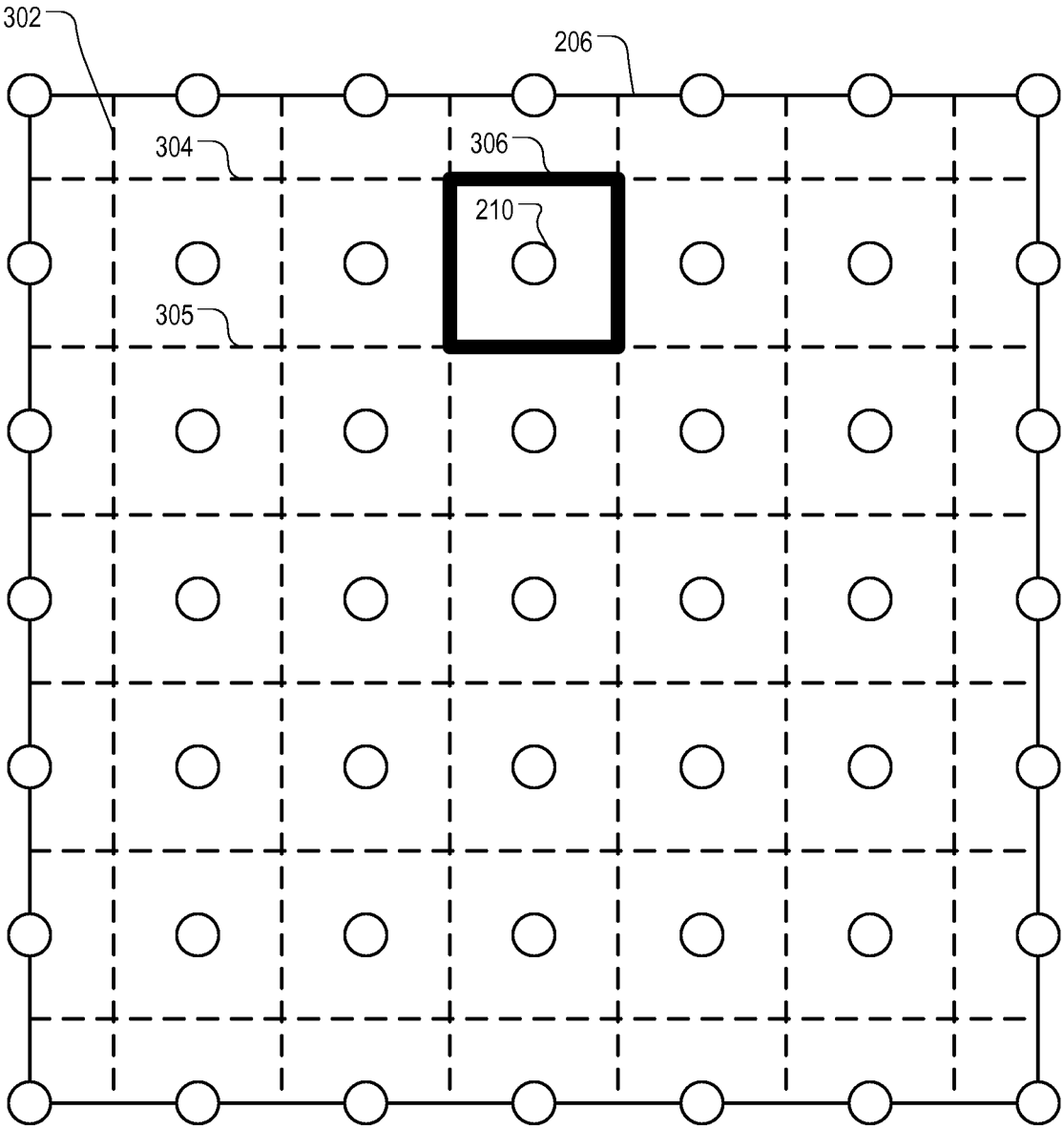
FIG. 3 is a diagram illustrating example techniques of creating cells for fine virtual sound sources.

FIG. 3 is a diagram illustrating example techniques of creating cells for fine virtual sound sources. Allocating virtual sound sources to cells is a stage of generating a coarse grid. A grid mapper, e.g., the grid mapper 102 of FIG. 1, upon receiving an original fine grid 206 of fine virtual sound sources in a space, assigns a respective cell to each virtual sound source in the grid. The original fine grid 206 can include an original number, e.g., K by L by M, of fine virtual sound sources evenly distributed in a three-dimensional space. The positive integer numbers K, L and M can correspond to number of virtual sound sources along length, width and height of the space, respectively. For convenience, a two-dimensional projection having a dimension of 7 by 7 is shown in FIG. 3.

Assigning cells to the virtual sound sources can include determining borders, e.g., borders 302 and 304, for segregating the space into cells referred to as fine cells. The borders 302 and 304 separating virtual sound sources in the fine grid 206 are designated as fine borders, represented as dashed lines in the figures. The fine borders 302 and 304 can be midlines or mid-planes between virtual sound sources. A midline or mid-plane can be a line or plane a point on which is equal-distant from two neighboring virtual sound sources. The grid mapper can designate each respective area or volume around a respective virtual sound source enclosed by corresponding borders as a cell corresponding to that virtual sound source. For example, the grid mapper can designate such an area or volume around virtual sound source 210 as a cell 306 corresponding to the virtual sound source 210. The grid mapper creates a respective cell for each virtual sound source in the fine grid 206.

Figure 4:
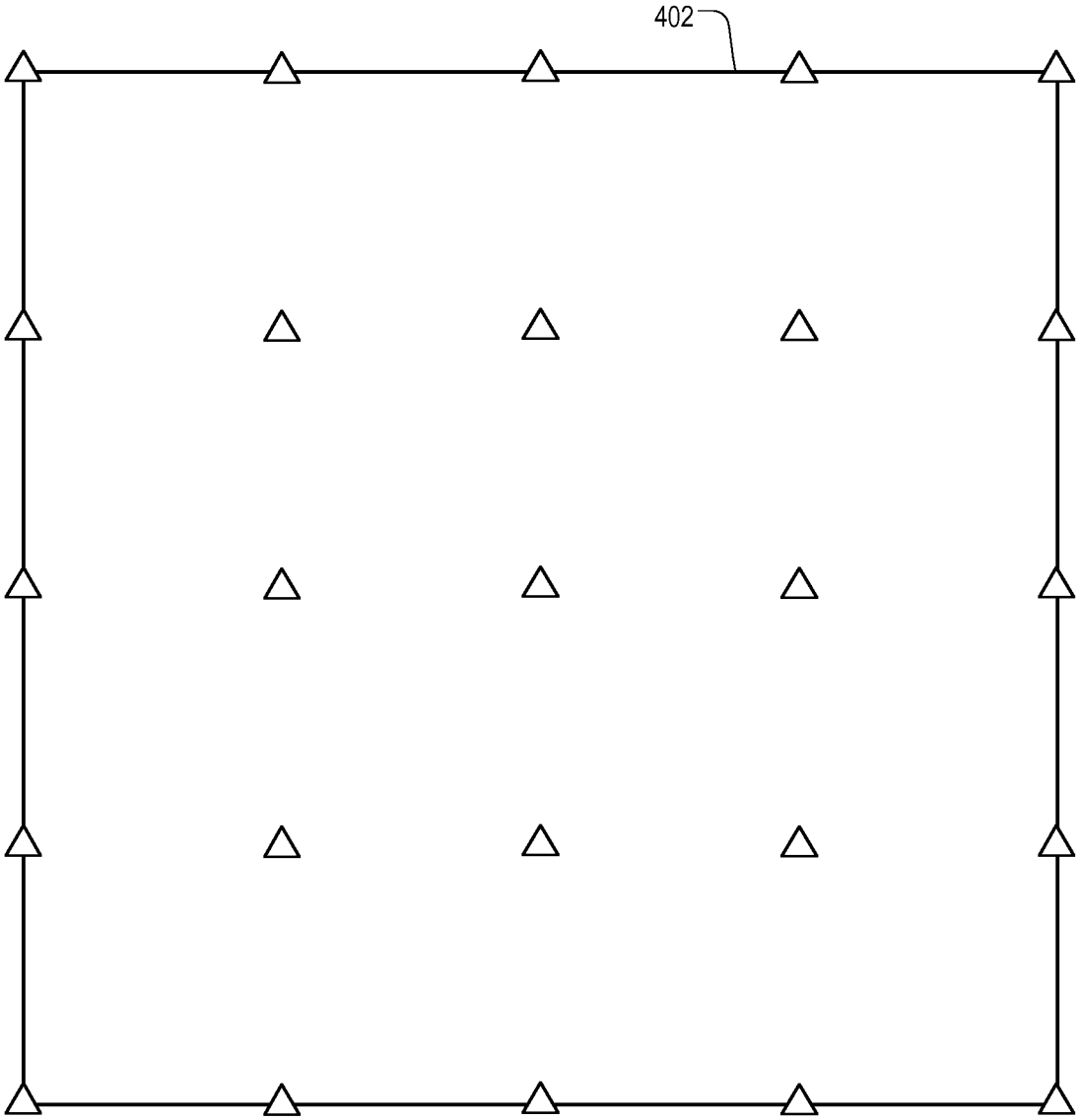
FIG. 4 is diagram illustrating example techniques of reducing number of virtual sound sources.

FIG. 4 is diagram illustrating example techniques of reducing number of virtual sound sources. Reducing number of virtual sound sources is another stage of generating a coarse grid. A grid mapper, e.g., the grid mapper 102 of FIG. 1, creates a set of virtual sound sources in the same space as represented by the fine grid 206 of FIG. 3. The grid mapper designates a set of locations in the space as a set of coarse virtual sound sources. The coarse virtual sound sources are fewer than the fine virtual sound sources as represented in the original fine grid 206. For example, the grid mapper can specify that a coarse grid 402 has P by Q by R virtual sound sources, where at least one of P and Q and R is smaller than K, L and M, respectively. For convenience, a two-dimensional projection having a dimension of 5 by 5 coarse virtual sound sources is shown in FIG. 4. Each coarse virtual sound source in the grid 402 is represented as a triangle. The coarse virtual sound sources may have an even distribution in the space. Upon creating the coarse grid 402, the grid mapper moves to next stages of processing, which calculate respective speaker gains for each coarse virtual sound source.

Figure 5:
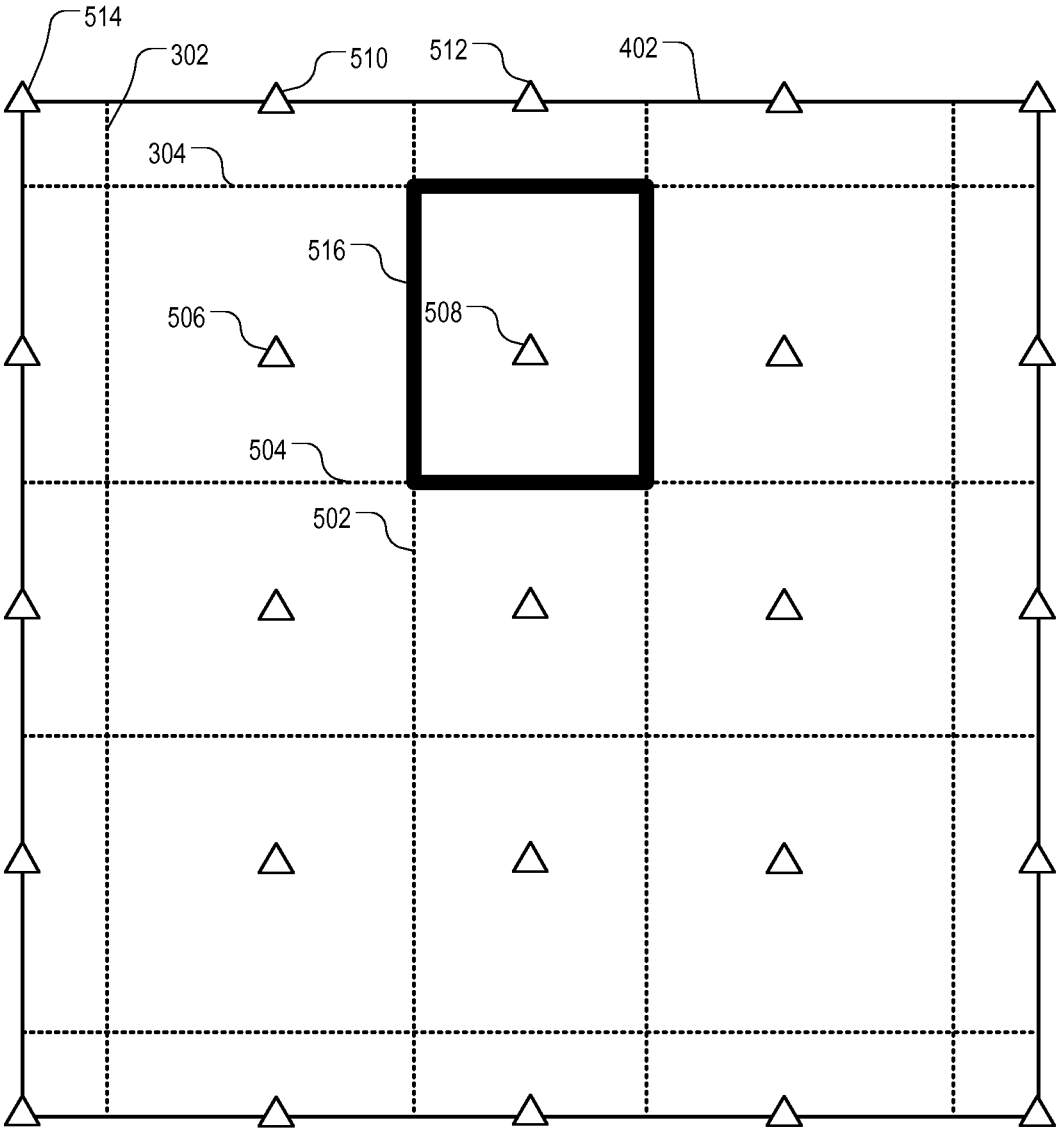
FIG. 5 is a diagram illustrating example techniques of creating cells for coarse virtual sound sources.

FIG. 5 is a diagram illustrating example techniques of creating cells for coarse virtual sound sources. Allocating cells to the reduced virtual sound sources is another stage of generating a coarse grid. A grid mapper, e.g., the grid mapper 102 of FIG. 1, assigns a respective coarse cell to each coarse virtual sound source in the coarse grid 402. Assigning coarse cells to the coarse virtual sound sources can include determining borders, e.g., borders 502 and 504, for separating the space into coarse cells. The borders 502 and 504 separating coarse virtual sound sources in the coarse grid 402 are designated as coarse borders, represented as dotted lines in the figures. The coarse borders 502 and 504 can be midlines or mid-planes between internal virtual sound sources, e.g., internal virtual sound sources 506 and 508, and between external virtual sound sources, e.g., external virtual sound sources 510 and 512, that are non-corner sound sources. In some first implementations, between an external virtual sound source 510 and an internal virtual sound source 506 or between a non-corner sound source 510 and a corner sound source 514, the grid mapper can determine a midline. In some second implementations, the grid mapper can designate the fine borders of the fine grid 206 between an internal sound source and an external virtual sound source, or between a non-corner sound source and a corner sound source, as the coarse borders. For example, in the second implementations, the grid mapper can use border 304, of FIG. 3, to separate internal virtual sound source 506 and external sound source 510, and use border 302, also of FIG. 3, to separate non-corner sound source 510 and corner sound source 514.

The grid mapper designates each respective area or volume around a respective coarse virtual sound source enclosed by a respective border as a coarse cell corresponding to that coarse virtual sound source. For example, the grid mapper can designate a space around virtual sound source 508 as a coarse cell 516 corresponding to the coarse virtual sound source 508. The grid mapper can then process to a next stage of processing.

Figure 6:
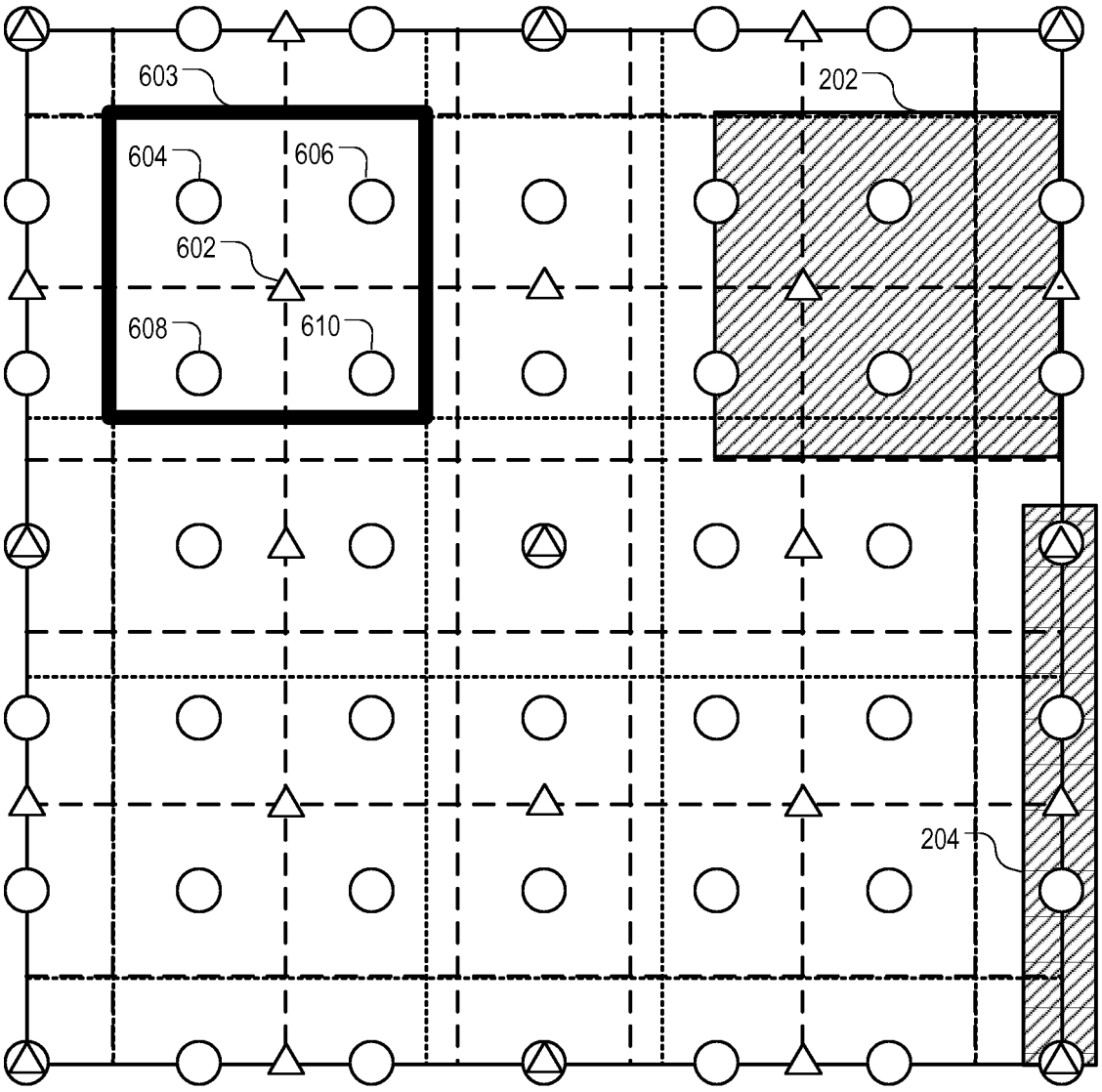
FIG. 6 is a diagram illustrating example techniques of mapping fine virtual sound sources to coarse virtual sound sources in determining speaker gains.

FIG. 6 is a diagram illustrating example techniques of mapping fine virtual sound sources to coarse virtual sound sources in determining speaker gains. A grid mapper, e.g., the grid mapper 102 of FIG. 1, created coarse virtual sound sources, including a particular virtual sound source 602, so far without information of corresponding speaker gains. The grid mapper can determine speaker gains corresponding to the coarse virtual sound sources based on overlaps between fine cells and coarse cells.

For example, the grid mapper determines that the coarse virtual sound source 602 is associated with a coarse cell 603. The grid mapper determines that the coarse cell 603 overlaps with four fine cells, associated with fine virtual sound sources 604, 606, 608 and 610, respectively. The grid mapper can calculate a respective ratio of the overlap, indicating respective amount of the overlap. The ratio of the overlap may be the ratio between the area (or volume) of the respective fine cell with the coarse cell and the total area (or volume) of the respective fine cell.

For example, as shown in FIG. 6, the grid mapper can determine that the entire fine cell corresponding to the fine virtual sound sources 604 is inside the coarse cell 603. In response, the grid mapper can determine a ratio of the overlap for the fine cell corresponding to the original virtual sound sources 604 is 1.00, or 100 percent. Likewise, the grid mapper can determine that the respective ratios of the overlap of the fine cells corresponding to the fine virtual sound source 606 and 608 are approximately 0.83, or 83 percent, and that the ratio of the overlap of the fine cell corresponding to the fine virtual sound source 610 is approximately 0.69, or 69 percent.

Accordingly, the grid mapper can determine the speaker gain contribution of virtual sound source 602 by summing the contributions of the virtual sound sources 604, 606, 608 and 610 weighted by the overlap ratios. The summing can be implemented in various techniques. For example, the summing can be implemented using the same techniques as the techniques for adding contributions from all virtual sound sources to the available speakers during playback.

More generally, the grid mapper can determine the speaker gain contribution using Equation 1 below.

$$G_{ui}=[\Sigma_v w_{uv}(h_{uv}g_{vi})^p]^{1/p} \quad (1)$$

In Equation 1, $G_{ui}$ represents contribution of coarse virtual sound source u to speaker i; p=1, 2, 3 . . . ; $h_{uv}$ is a height correction term that can assign equal or different weights to different sound sources. For example, in some implementations, $h_{uv}$ can give more weight to fine virtual sound sources that are located closer to the bottom, e.g., the floor of a listening room, relative to the position of the coarse virtual sound sources, and $g_{vi}$ represents gain contributions of the original fine virtual sound source v to speaker i. In some other implementations, $h_{uv}$ could be set to one for all fine virtual sound sources, if a discrimination between sound sources at different heights is not desired. In addition, $w_{uv}$ is a weight of fine virtual sound source v to coarse virtual sound source u, where, for a fine cell that falls completely within a coarse cell, $w_{uv}=1$; for a fine cell that falls partially within a coarse cell corresponding to u, $0<w_{uv}<1$; for a fine cell that falls not overlapping the coarse cell, $w_{uv}=0$. For instance, the weight may correspond to the ratio of overlap.

The grid mapper may perform additional stages of coarse graining, either from the original grid or from the coarse grid. During rendering, a renderer may use the coarse grid to determine contribution of coarse virtual sound sources to an audio object having a non-zero apparent size. The renderer may use a fine grid in zero-sized panning, where the apparent size of an audio object is zero.

In the example shown, the audio object 202 is originally represented by six fine virtual sound sources including four internal virtual sound sources and two external audio sources. The audio object 204 is originally represented by four fine external virtual sound sources. The renderer can use the coarse grid to represent the audio object 202 and audio object 204. In the coarse grid, the audio object 202 is represented by two coarse virtual sound sources, one internal and one external. The audio object 204 is represented by three coarse virtual sound sources, all external. The reduction in number of representative sound sources reduces requirement of computational resources without sacrificing playback quality.

Figure 7:
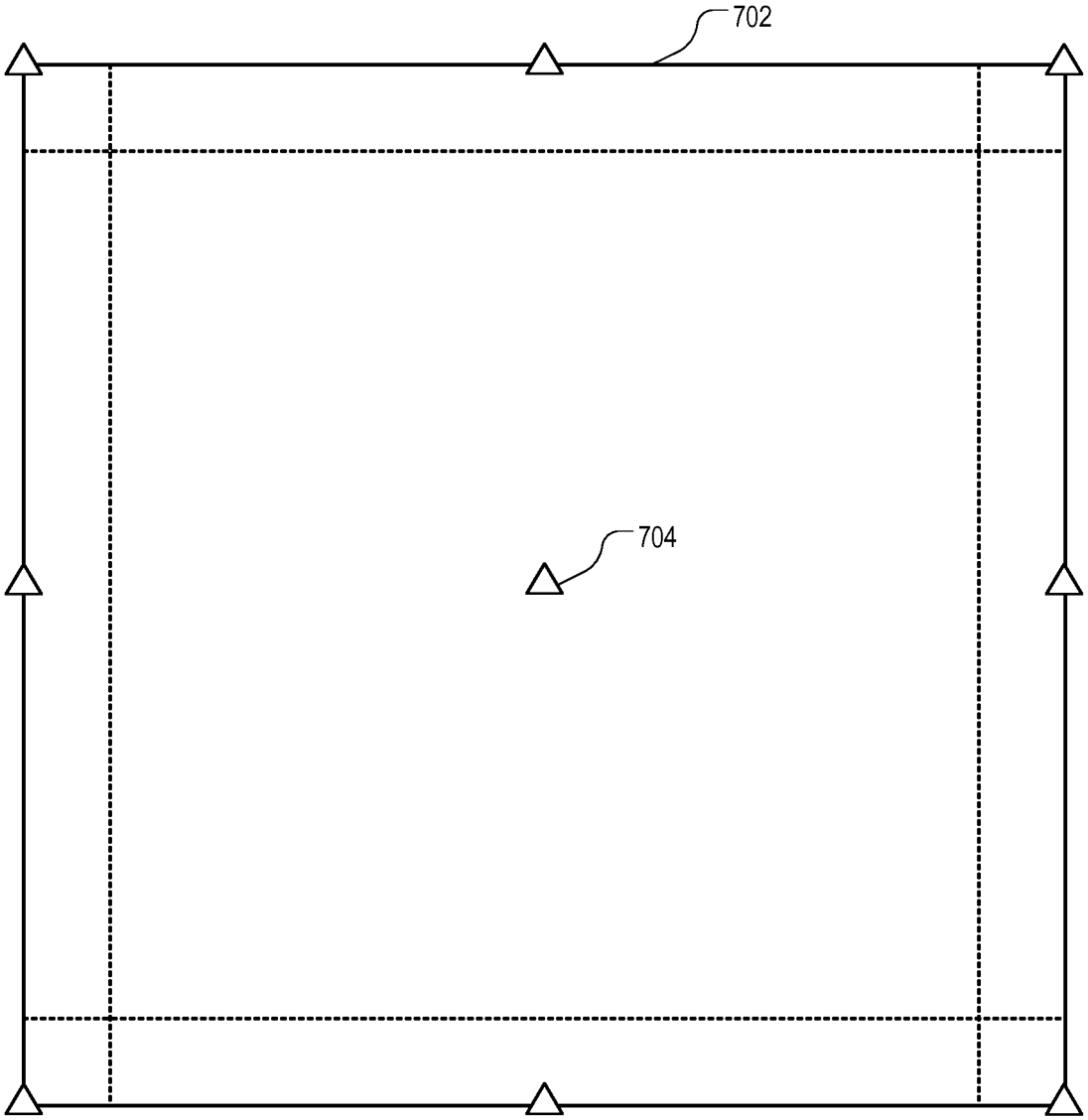
FIG. 7 is diagram illustrating example techniques of reducing number of virtual sound sources for large audio objects.

FIG. 7 is diagram illustrating example techniques of reducing the number of virtual sound sources for large audio objects. For large audio objects having an apparent size approaching the entire space, e.g., an entire room, a grid mapper can create coarse grid 702 that has only one internal coarse virtual sound source 704. Other coarse virtual sound sources in the coarse grid 702 are external coarse virtual sound sources. All coarse virtual sound sources can be distributed evenly in the coarse grid 702. The coarse grid 702 can be a grid having 3 by 3 by 3 virtual sound sources. A two dimensional projection is shown in FIG. 7.

At run time, a renderer may choose the fine grid 206, coarse grid 402, or coarsest grid 702 based on a size of an audio object and one or more size threshold values. For example, the grid mapper can generate a series of grids of Grid0, Grid1, Grid2 . . . GridN, where Grid0 is the original fine grid, e.g., the grid 206 of FIG. 2, and Grid1 through GridN are a series of successively coarser grids including coarse grid 402 of FIG. 4 and coarse grid 702. A renderer can define a series of successfully larger size threshold values s1, s2 . . . sN. The renderer can determine output speaker gains as follows.

- If a size of an audio object s satisfies the condition s<s1, then the renderer interpolates gains computed from Grid0 with gains computed with Grid1;
- If s(i−1)<=s<si, then the renderer interpolates the gains coming from Grid(i−1) with gains computed with Grid (i);
- If s>sN, then the renderer computes the speaker gains based on GridN.

For example, at run time, the renderer can interpolate gains from grid 206 and gains from grid 402 upon determining that an audio object has a size that is less than 0.2, interpolate gains from grid 402 and gains from grid 702 upon determining that an audio object has a size that is between 0.2 and 0.5, and determine the gains using grid 702 upon determining that an audio object has a size that is greater than 0.5, where the size of the space is 1.

Figure 8:
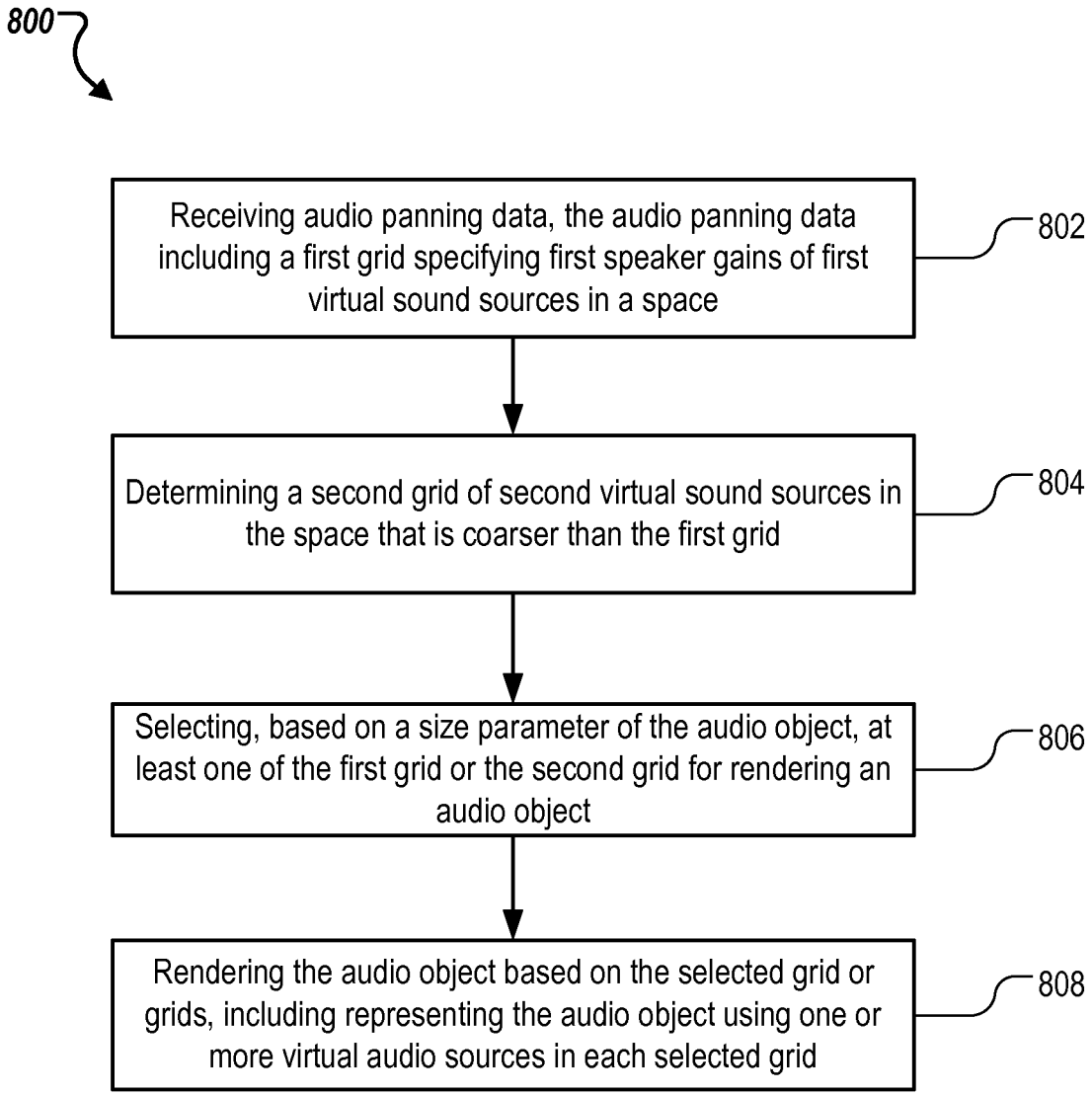
FIG. 8 is a flowchart of an example process of rendering an audio object having an apparent size.

FIG. 8 is a flowchart of an example process 800 of rendering an audio object having an apparent size. The process 800 can be performed by a system that includes one or more computer processors, e.g., the audio processing system 100 of FIG. 1.

The system receives (802) audio panning data. The audio panning data includes a first grid specifying first speaker gains of first virtual sound sources in a space to speaker gains. The panning data can be data provided by a conventional panner that has full resolution. The first grid can be a fine grid having K by L by M fine virtual sound sources, for example. The first speaker gains of the fine virtual sound sources have been determined by the conventional panner.

The system determines (804) a second grid of second virtual sound sources in the space. Relative to the first grid, the second grid is a coarse grid, less dense than the first grid. Determining the second grid includes mapping the first speaker gains of the first virtual sound sources into second speaker gains of the second virtual sound sources. Determining the second grid can include the following operations. The system partitions the space of the first grid into first cells. Each first cell is a fine cell corresponding to a respective first virtual sound source in the first grid. The system partitions the space into second cells that are fewer and coarser than the first cells. Each second cell corresponds to a respective second virtual sound source, which the system creates. The system maps respective first speaker gains from each first virtual sound sources into one or more second speaker gains of one or more second virtual sound sources based on an amount of overlap between a corresponding first cell and one or more corresponding second cells.

Mapping the respective first contribution (e.g., first speaker gain) from each first virtual sound sources into one or more second contributions (e.g., second speaker gains) can include the following operations. The system determines a respective amount of overlap of the corresponding first cell in each of the one or more corresponding second cells. The system determines a respective weight of the speaker gains in each of the second speaker gains according to the respective amount of overlap. The system apportions the first speaker gains to each of the one or more second contributions according to the respective weight.

The space can be a two-dimensional or three-dimensional space. The first virtual sound sources can include external first sound sources located on an outer boundary of the space and internal first sound sources located inside the space. The second virtual sound sources can include external second sound sources located on the outer boundary of the space and internal second sound sources located inside the space. The external second sound sources can include corner sound sources and non-corner sources. Partitioning the space into the second cells includes the following operations. Between each external sound source and a corresponding internal sound source, or between each corner sound source and a corresponding non-corner source, the system partitions a corresponding second cell according to a fine cell border of a corresponding first cell, which is a fine cell. Between each pair of internal second sound sources, or between each pair of non-corner sound sources, the system partitions a corresponding second cell by a midline between the two sound sources of the pair.

The system selects (806), based on a size parameter of the audio object, at least one of the first grid or second grid for rendering an audio object. In some implementations, selecting at least one of the first grid or second grid can include the following operations. The system receives the audio object. The system determines the apparent size of the sound space based on the size parameter in the audio object. The system selects the first grid upon determining that the apparent size is not greater than a threshold or selecting the second grid upon determining that the apparent size is greater than the threshold.

The system renders (808) the audio object based on the selected grid or grids, including representing the audio object using one or more virtual sound sources in each selected grid that are enclosed in a sound space defined by the size parameter. Rendering the audio object includes providing signals representing the audio object to one or more speakers according to the output speaker gains determined in stage 806.

In some implementations, the system uses two or more grids in rendering the audio object. In this case, system determines a third grid of third virtual sound sources in the space. The first grid is a fine grid; the second grid is a coarse grid; the third grid is in the middle, coarser than the first grid but less coarse than the second grid. The third grid has fewer third virtual sound sources than the first virtual sound sources and more third virtual sound sources than the second virtual sound sources. Determining the third grid includes mapping the first contribution (e.g., first speaker gains) into third contributions (e.g., third speaker gains) corresponding to the third virtual sound sources. Selecting a grid among the three grids can include the following operations. The system selects the first grid and the third grid upon determining that the apparent size is smaller than a first threshold, e.g., 0.2, where the space is a unit space of one.

When the system uses two or more grids, the system determines output speaker gains by interpolating speaker gains. For example, when the first and third grids are selected, the system can determine the output speaker gains by interpolating speaker gains computed based on the first grid and the third grid. The system selects the third grid and the second grid upon determining that the apparent size is between the first threshold and a second threshold, e.g., 0.5 that is larger than the first threshold. The system determines output speaker gains by interpolating speaker gains determined based on the third grid and the second grid. The system selects the second grid upon determining that the apparent size is larger than the second threshold. The system designates speaker gains determined based on the second grid as output speaker gains.

Example System Architecture

Figure 9:
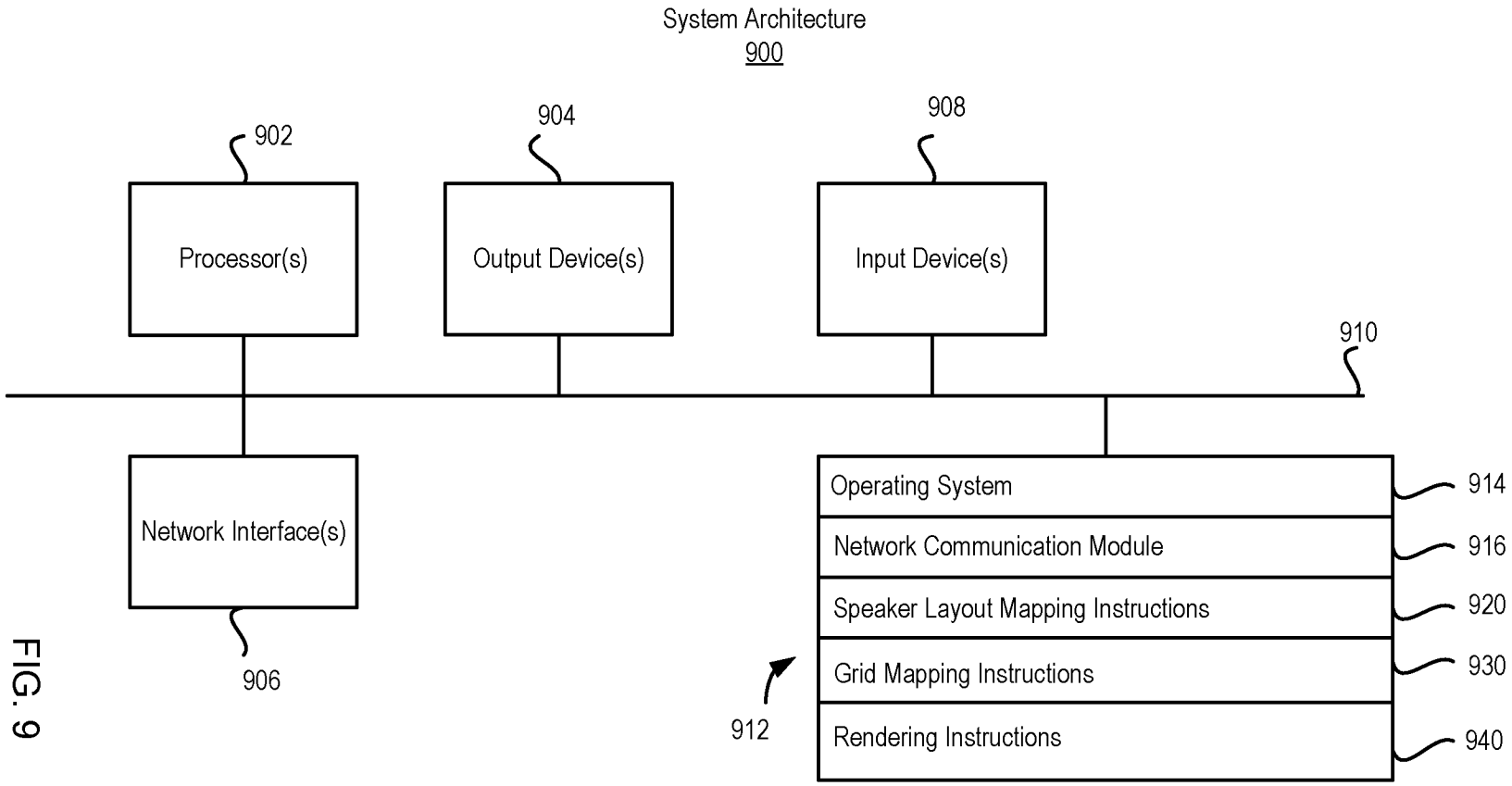
FIG. 9 is a block diagram of an example system architecture for an audio rendering system implementing the features and operations described in reference to FIGS. 1-8.

FIG. 9 is a block diagram of an example system architecture for an audio rendering system implementing the features and operations described in reference to FIGS. 1-8. Other architectures are possible, including architectures with more or fewer components. In some implementations, architecture 900 includes one or more processors 902 (e.g., dual-core Intel® Xeon® Processors), one or more output devices 904 (e.g., LCD), one or more network interfaces 906, one or more input devices 908 (e.g., mouse, keyboard, touch-sensitive display) and one or more computer-readable mediums 912 (e.g., RAM, ROM, SDRAM, hard disk, optical disk, flash memory, etc.). These components can exchange communications and data over one or more communication channels 910 (e.g., buses), which can utilize various hardware and software for facilitating the transfer of data and control signals between components.

The term "computer-readable medium" refers to a medium that participates in providing instructions to processor 902 for execution, including without limitation, non-volatile media (e.g., optical or magnetic disks), volatile media (e.g., memory) and transmission media. Transmission media includes, without limitation, coaxial cables, copper wire and fiber optics.

Computer-readable medium 912 can further include operating system 914 (e.g., a Linux® operating system), network communication module 916, speaker layout mapping instructions 920, grid mapping instructions 930 and rendering instructions 940. Operating system 914 can be multi-user, multiprocessing, multitasking, multithreading, real time, etc. Operating system 914 performs basic tasks, including but not limited to: recognizing input from and providing output to network interfaces 906 and/or devices 908; keeping track and managing files and directories on computer-readable mediums 912 (e.g., memory or a storage device); controlling peripheral devices; and managing traffic on the one or more communication channels 910. Network communications module 916 includes various components for establishing and maintaining network connections (e.g., software for implementing communication protocols, such as TCP/IP, HTTP, etc.).

The speaker layout mapping instructions 920 can include computer instructions that, when executed, cause processor 902 to perform operations of receiving speaker layout information specifying which speaker is located where in a space, receiving configuration information specifying grid size, e.g., 11 by 11 by 11, and determining a grid of virtual sound sources mapping positions to respective speaker gains for each speaker. Grid mapping instructions 930 can include computer instructions that, when executed, cause processor 902 to perform operations of the grid mapper 102 of FIG. 1, including mapping the grid generated by the speaker layout mapping instructions 920 to one or more coarse grids. Rendering instructions 940 can include computer instructions that, when executed, cause processor 902 to perform operations of renderer 114 of FIG. 1, including selecting one or more grids for rendering an audio object.

Architecture 900 can be implemented in a parallel processing or peer-to-peer infrastructure or on a single device with one or more processors. Software can include multiple software components or can be a single body of code.

The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language (e.g., Objective-C, Java), including compiled or interpreted languages, and it can be deployed in any form, including as a stand-alone program or as a module, component, subroutine, a browser-based web application, or other unit suitable for use in a computing environment.

Suitable processors for the execution of a program of instructions include, by way of example, both general and special purpose microprocessors, and the sole processor or one of multiple processors or cores, of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor or a retina display device for displaying information to the user. The computer can have a touch surface input device (e.g., a touch screen) or a keyboard and a pointing device such as a mouse or a trackball by which the user can provide input to the computer. The computer can have a voice input device for receiving voice commands from the user.

The features can be implemented in a computer system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include, e.g., a LAN, a WAN, and the computers and networks forming the Internet.

The computing system can include clients and servers. A client and server are generally remote from each other and typically interact through a communication network. The relationship of client and server arises by virtue of computer programs running on the respective computers and having a client-server relationship to each other. In some embodiments, a server transmits data (e.g., an HTML page) to a client device (e.g., for purposes of displaying data to and receiving user input from a user interacting with the client device). Data generated at the client device (e.g., a result of the user interaction) can be received from the client device at the server.

A system of one or more computers can be configured to perform particular actions by virtue of having software, firmware, hardware, or a combination of them installed on the system that in operation causes or cause the system to perform the actions. One or more computer programs can be configured to perform particular actions by virtue of including instructions that, when executed by data processing apparatus, cause the apparatus to perform the actions.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

A number of implementations of the invention have been described. Nevertheless, it will be understood that various modifications can be made without departing from the spirit and scope of the invention.

The invention claimed is:

1. A method comprising:

receiving, by one or more processors, audio panning data, the audio panning data including a first grid specifying first speaker gains of first virtual sound sources in a space, the first speaker gains correspond to one or more speakers in the space;

partitioning the space into first cells, each first cell corresponding to a respective first virtual sound source in the first grid;

partitioning the space into second cells that are fewer than the first cells, each second cell corresponding to a respective second virtual sound source;

mapping the first speaker gains into second speaker gains of the second virtual sound sources;

selecting at least one of the first grid or second grid for rendering an audio object; and rendering the audio object based on the selected grid or grids.

2. The method of claim 1, wherein rendering the audio object based on the selected grid or grids comprises representing the audio object using one or more virtual sound sources in each selected grid that are enclosed in a sound space defined at least in part by a size parameter of the audio object.

3. The method of claim 1, wherein determining the second grid comprises:

mapping respective first speaker gains of each first virtual sound source into respective second speaker gains of one or more second virtual sound sources based on an amount of overlap between a corresponding first cell and one or more corresponding second cells.

4. The method of claim 3, wherein mapping the first speaker gains into the second speaker gains comprises:

determining a respective amount of overlap of each first cell and each second cell;

determining a respective weight of contribution of first speaker gains of each first virtual sound source to each second virtual sound source based on the amount of corresponding overlap; and apportioning the first speaker gains to each of the second speaker gains according to the respective weight.

5. The method of claim 3, wherein:

the space is a two-dimensional or three-dimensional space, the first virtual sound sources include external first sound sources located on an outer boundary of the space and internal first sound sources located inside the space, and the second virtual sound sources include external second sound sources located on the outer boundary of the space and internal second sound sources located inside the space, the external second sound sources including corner sound sources and non-corner sources.

6. The method of claim 5, wherein partitioning the space into the second cells comprises:

between each external sound source and a corresponding internal sound source, or between each corner sound source and a corresponding non-corner source, partitioning a corresponding second cell according to a cell border of a corresponding first cell; and between each pair of internal second sound sources, or between each pair of non-corner sources, partitioning a corresponding second cell by a midline between two sound sources of the pair.

7. The method of claim 1, wherein selecting at least one of the first grid or second grid comprises:

receiving the audio object;

determining an apparent size of the audio object based on a size parameter; and selecting the first grid upon determining that the apparent size is not greater than a threshold or selecting the second grid upon determining that the apparent size is greater than the threshold.

8. The method of claim 1, wherein:

selecting at least one of the first grid or second grid comprises selecting the first grid and the second grid, and rendering the audio object includes determining output speaker gains by interpolating the first speaker gains and the second speaker gains based on an apparent size of the audio object.

9. The method of claim 1, comprising determining a third grid of third virtual sound sources in the space, including mapping the first speaker gains into third speaker gains corresponding to the third virtual sources, wherein the third grid has fewer third virtual sound sources than the first virtual sound sources and more third virtual sound sources than the second virtual sound sources.

10. The method of claim 9, wherein selecting at least one of the first grid or second grid for rendering the audio object comprises:

selecting the first grid and the third grid upon determining that an apparent size of the sound space is smaller than a first threshold, wherein rendering the audio object includes determine output speaker gains by interpolating the first speaker gains and the third speaker gains;

selecting the third grid and the second grid upon determining that the apparent size is between the first threshold and a second threshold that is larger than the first threshold, wherein rendering the audio object includes determine output speaker gains by interpolating the third speaker gains and the second speaker gains; and selecting the second grid upon determining that the apparent size is larger than the second threshold, wherein rendering the audio object includes determine designating the second speaker gains as output speaker gains.

11. The method of claim 10, wherein rendering the audio object comprises:

providing signals representing the audio object to one or more speakers according to the output speaker gains.

12. A system comprising:

one or more processors; and a non-transitory computer-readable medium storing instructions that, when executed by the one or more processors, cause the one or more processors to perform operations comprising operations of claim 1.

13. A non-transitory computer-readable medium storing instructions that, when executed by one or more processors, cause the one or more processors to perform operations comprising operations of claim 1.

14. The method of claim 1, wherein mapping the first speaker gains into second speaker gains of the second virtual sound sources is based at least in part on a height of an audio object.

* * * * *